US011482369B2

(12) United States Patent
Nah et al.

(10) Patent No.: US 11,482,369 B2
(45) Date of Patent: Oct. 25, 2022

(54) MAGNETIC CORE, COIL COMPONENT, AND ELECTRONIC COMPONENT INCLUDING SAME

(71) Applicant: LG INNOTEK CO., LTD., Seoul (KR)

(72) Inventors: Hyun Min Nah, Seoul (KR); Seok Bae, Seoul (KR); Jai Hoon Yeom, Seoul (KR); Sang Won Lee, Seoul (KR); Hyun Ji Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 554 days.

(21) Appl. No.: 16/469,069

(22) PCT Filed: Dec. 19, 2017

(86) PCT No.: PCT/KR2017/015019
§ 371 (c)(1),
(2) Date: Jun. 12, 2019

(87) PCT Pub. No.: WO2018/117595
PCT Pub. Date: Jun. 28, 2018

(65) Prior Publication Data

US 2020/0075218 A1 Mar. 5, 2020

(30) Foreign Application Priority Data

Dec. 20, 2016 (KR) ..... 10-2016-0174876
Dec. 20, 2016 (KR) ..... 10-2016-0174877

(51) Int. Cl.
*H01F 27/24* (2006.01)
*H01F 27/26* (2006.01)
(Continued)

(52) U.S. Cl.
CPC ..... *H01F 27/263* (2013.01); *H01F 27/022* (2013.01); *H01F 27/04* (2013.01);
(Continued)

(58) Field of Classification Search
CPC ..... H01F 27/263; H01F 27/022; H01F 27/04; H01F 27/2823; H01F 27/36;
(Continued)

(56) References Cited

U.S. PATENT DOCUMENTS 5,731,666 A * 3/1998 Folker ..... H01F 3/12 315/276
6,980,077 B1 * 12/2005 Chandrasekaran ... H01F 27/255 336/212

(Continued)

FOREIGN PATENT DOCUMENTS

CN 1996515 7/2007
CN 202584976 12/2012

(Continued)

OTHER PUBLICATIONS

Chinese Office Action dated Jun. 3, 2021 issued in Application No. 201780078463.1.

(Continued)

*Primary Examiner* — Tuyen T Nguyen
(74) *Attorney, Agent, or Firm* — KED & Associates LLP

(57) ABSTRACT

A magnetic core according to one embodiment of the present invention includes a first magnetic core having pure iron or an Fe-based alloy and a second magnetic core disposed to surround at least a part of an outer circumferential surface of the first magnetic core and including ferrite.

15 Claims, 13 Drawing Sheets

(51) Int. Cl.

| | |
|---|---|
| ***H01F 27/02*** | (2006.01) |
| ***H01F 27/04*** | (2006.01) |
| ***H01F 27/28*** | (2006.01) |
| ***H01F 27/36*** | (2006.01) |

(52) U.S. Cl.
CPC ..... *H01F 27/24* (2013.01); *H01F 27/2823* (2013.01); *H01F 27/36* (2013.01); *H01F 27/363* (2020.08)

(58) Field of Classification Search
CPC ..... H01F 27/306; H01F 37/00; H01F 27/02; H01F 2003/106; H01F 3/10
See application file for complete search history.

(56) References Cited

U.S. PATENT DOCUMENTS

| | | | | |
|---|---|---|---|---|
| 7,443,274 | B2 * | 10/2008 | Lee | H01F 1/37 336/84 M |
| 9,019,061 | B2 * | 4/2015 | Chandrasekaran | H01F 3/10 336/212 |
| 9,805,854 | B2 * | 10/2017 | Yeom | H01F 3/14 |
| 2007/0159289 | A1 | 7/2007 | Lee et al. | |
| 2010/0277267 | A1 | 11/2010 | Bogert et al. | |
| 2014/0084697 | A1 | 3/2014 | Yasuda et al. | |
| 2015/0380156 | A1 | 12/2015 | Takiguchi et al. | |

FOREIGN PATENT DOCUMENTS

| | | |
|---|---|---|
| CN | 203931784 | 11/2014 |
| CN | 105845385 | 8/2016 |
| JP | 2014-192498 | 10/2014 |
| KR | 10-1406640 | 6/2014 |

OTHER PUBLICATIONS

International Search Report and Written Opinion dated Mar. 28, 2018 issued in Application No. PCT/KR2017/015019.

* cited by examiner

[Fig. 1]
100
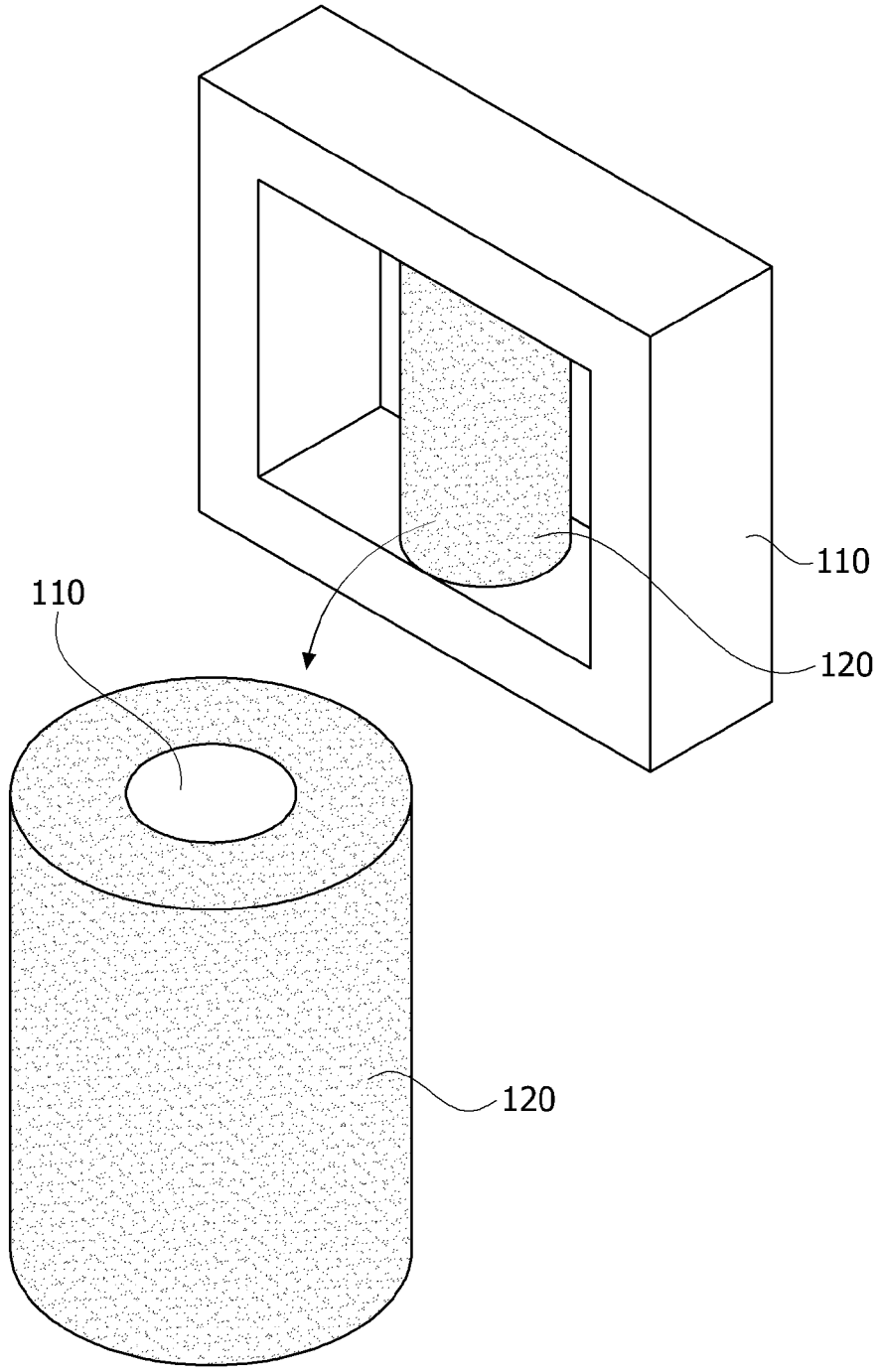

[Fig. 2]
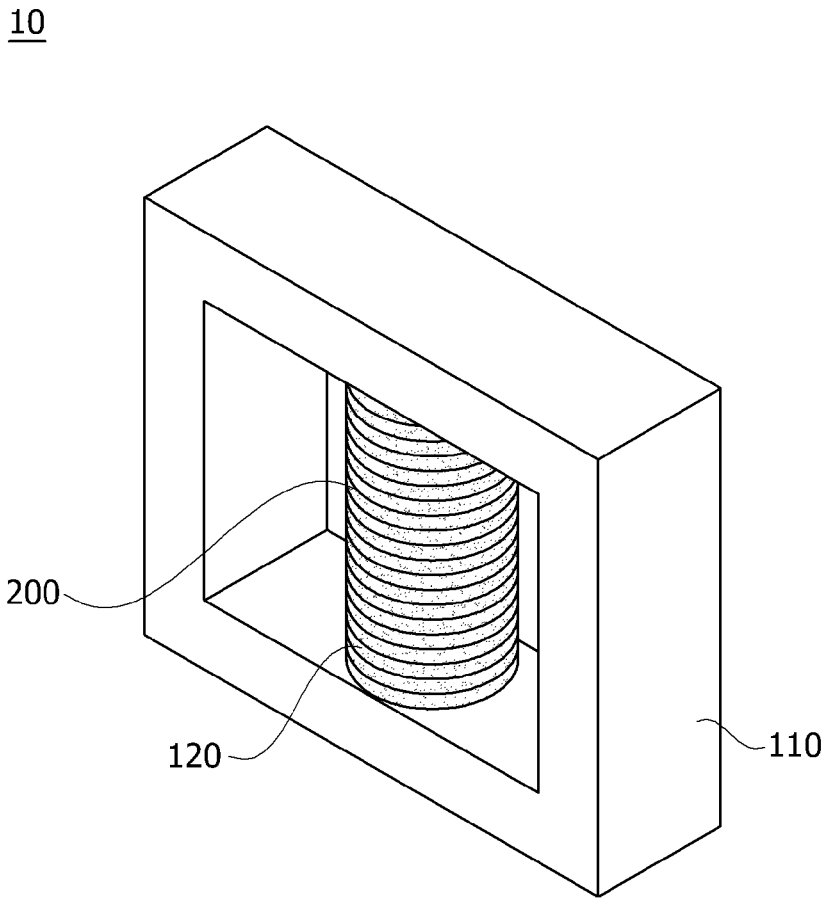

[Fig. 3]
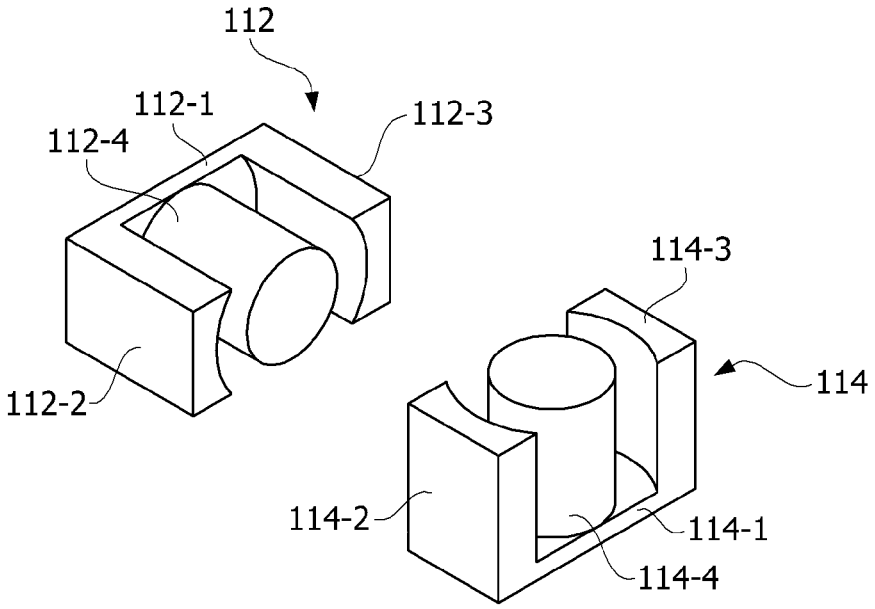
(a)
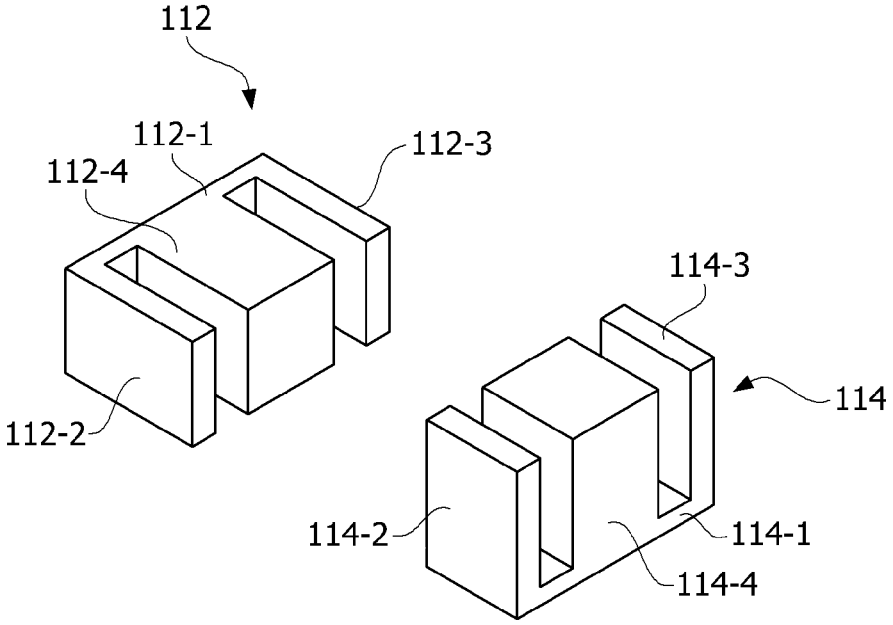
(b)

[Fig. 4]
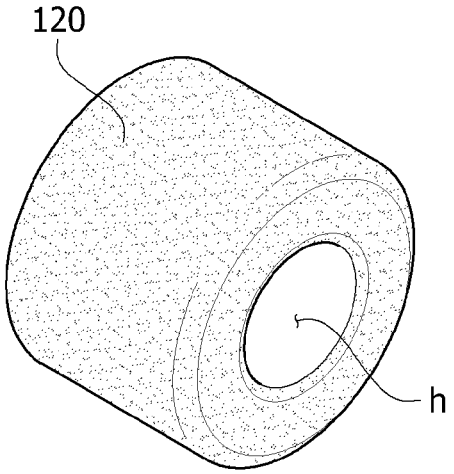
(a)
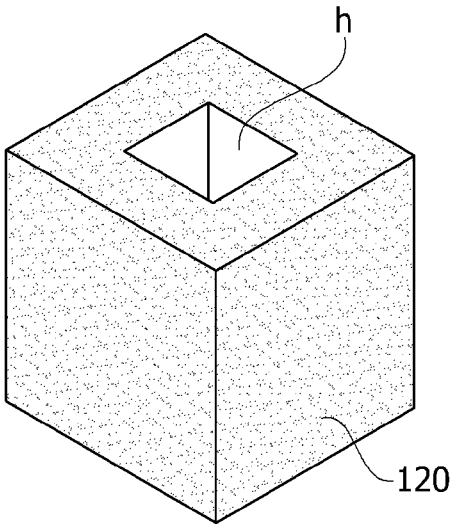
(b)

[Fig. 5]
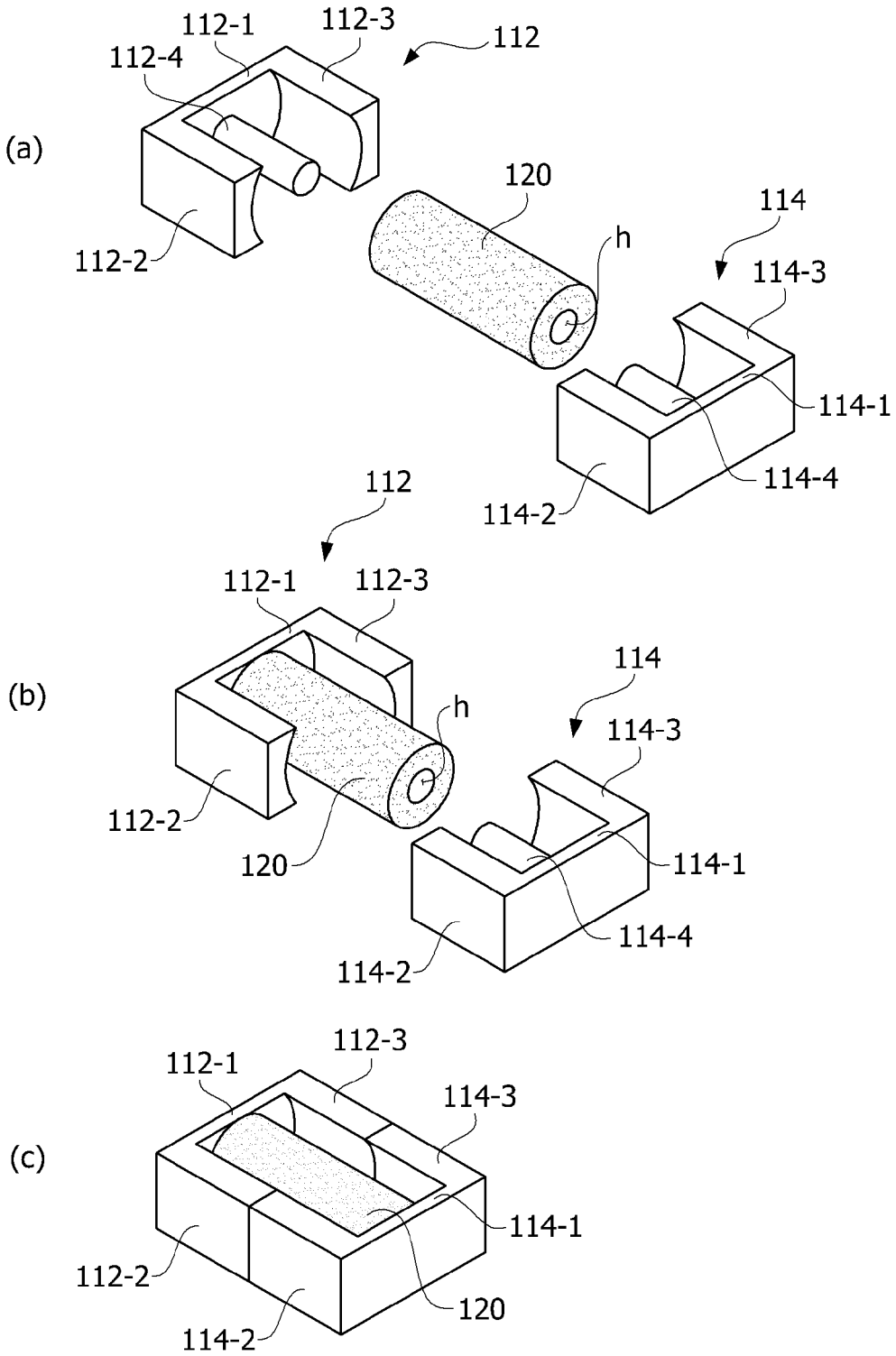

[Fig. 6]
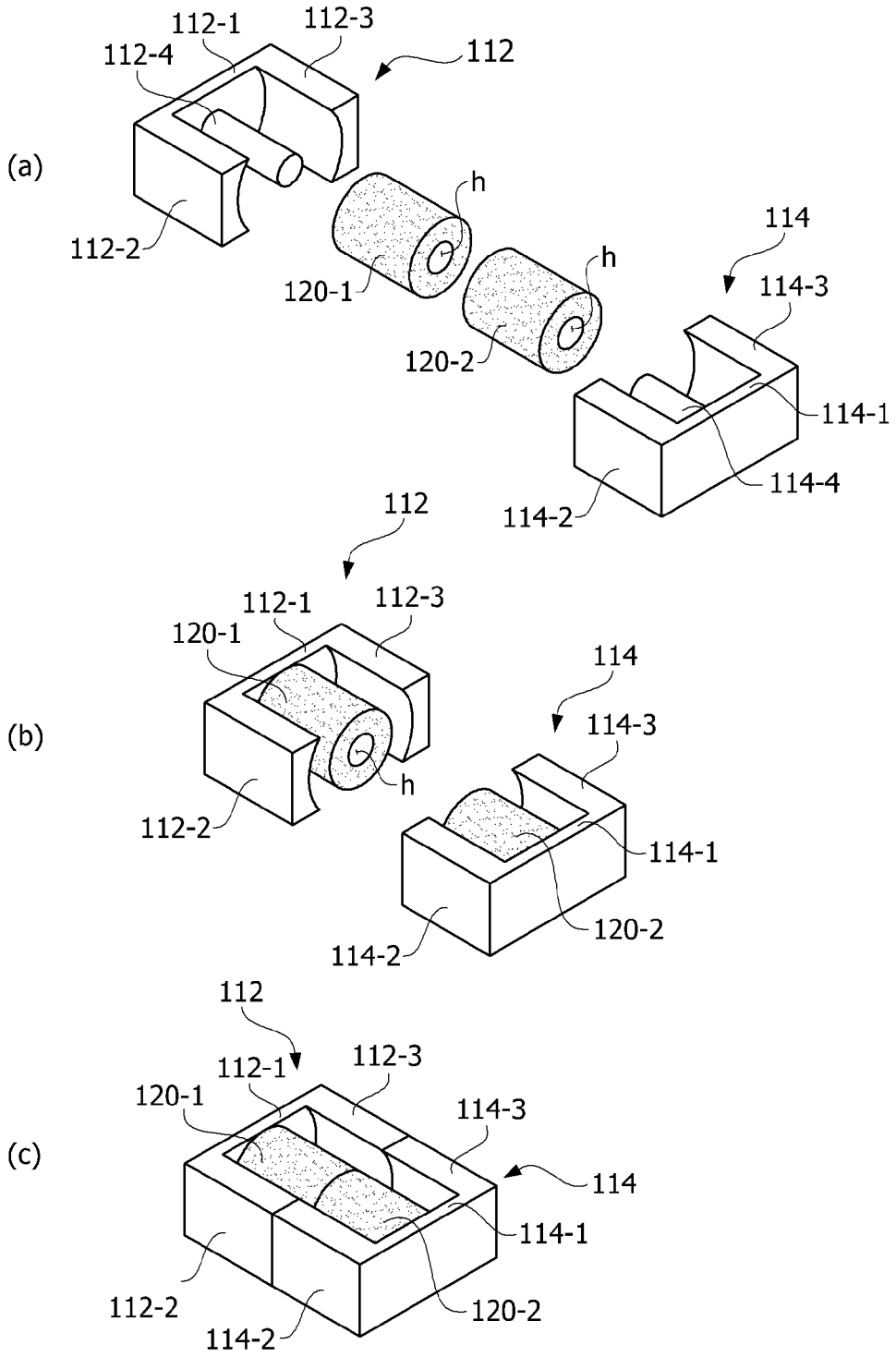

[Fig. 7]
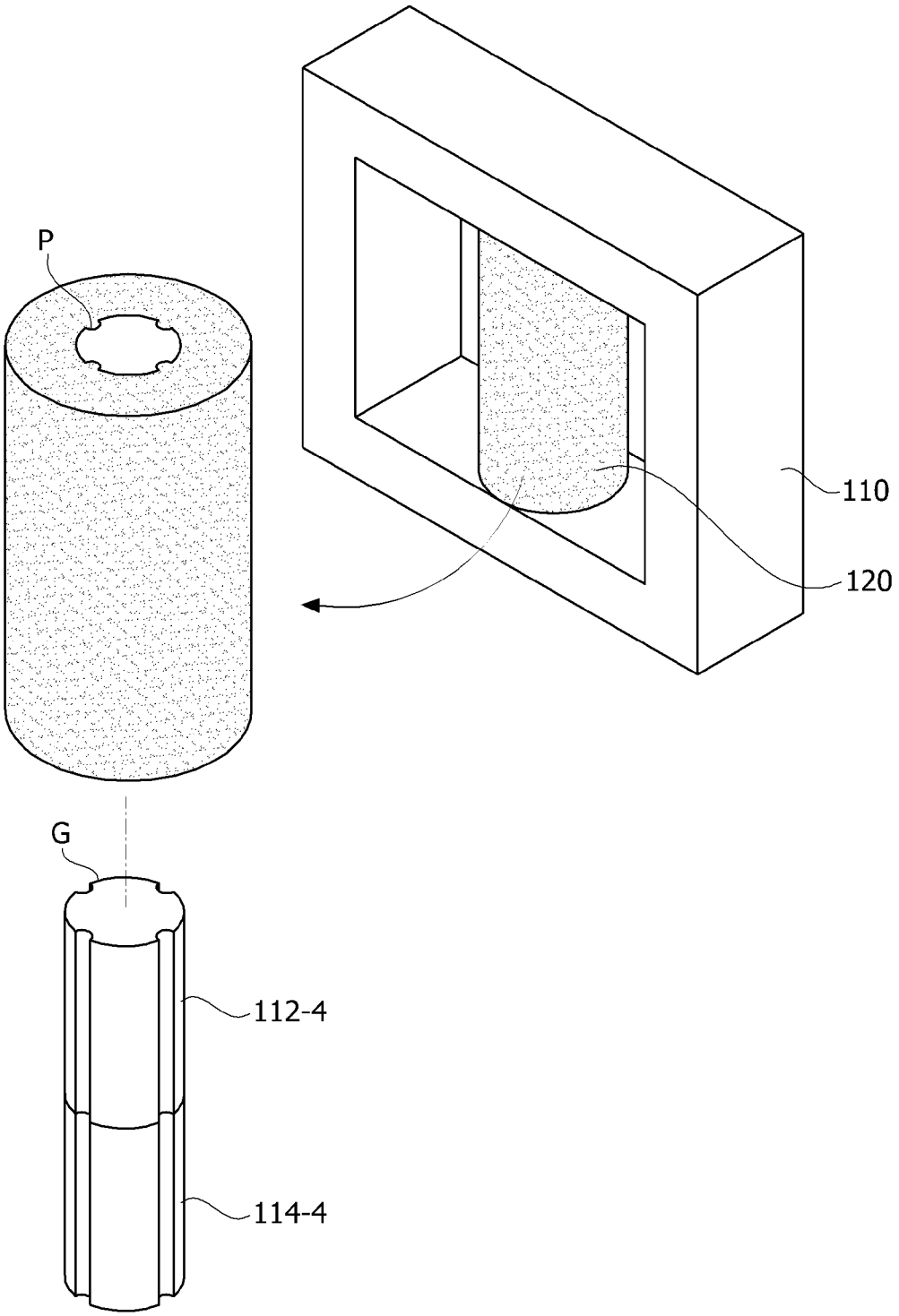

[Fig. 8]
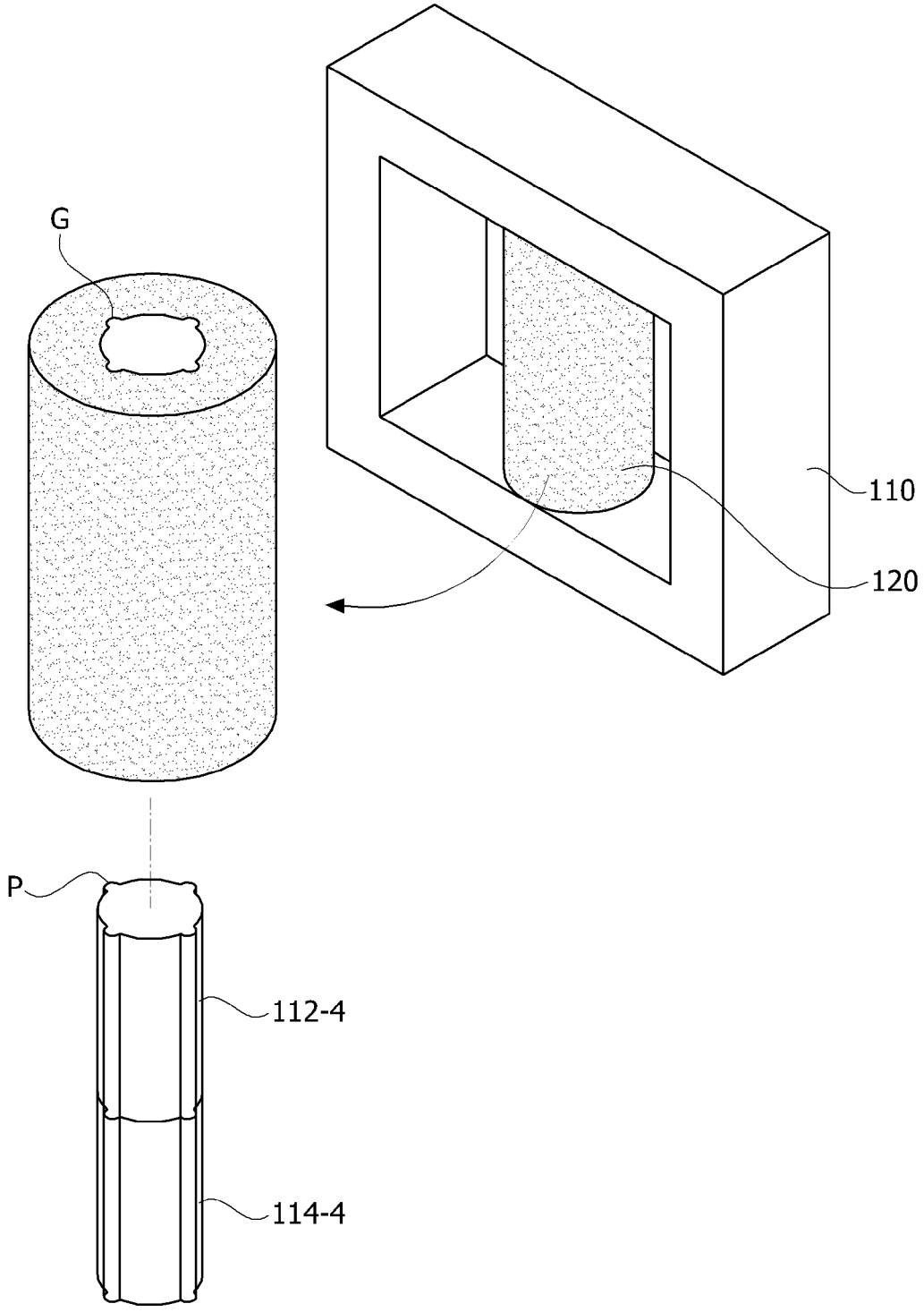

[Fig. 9]
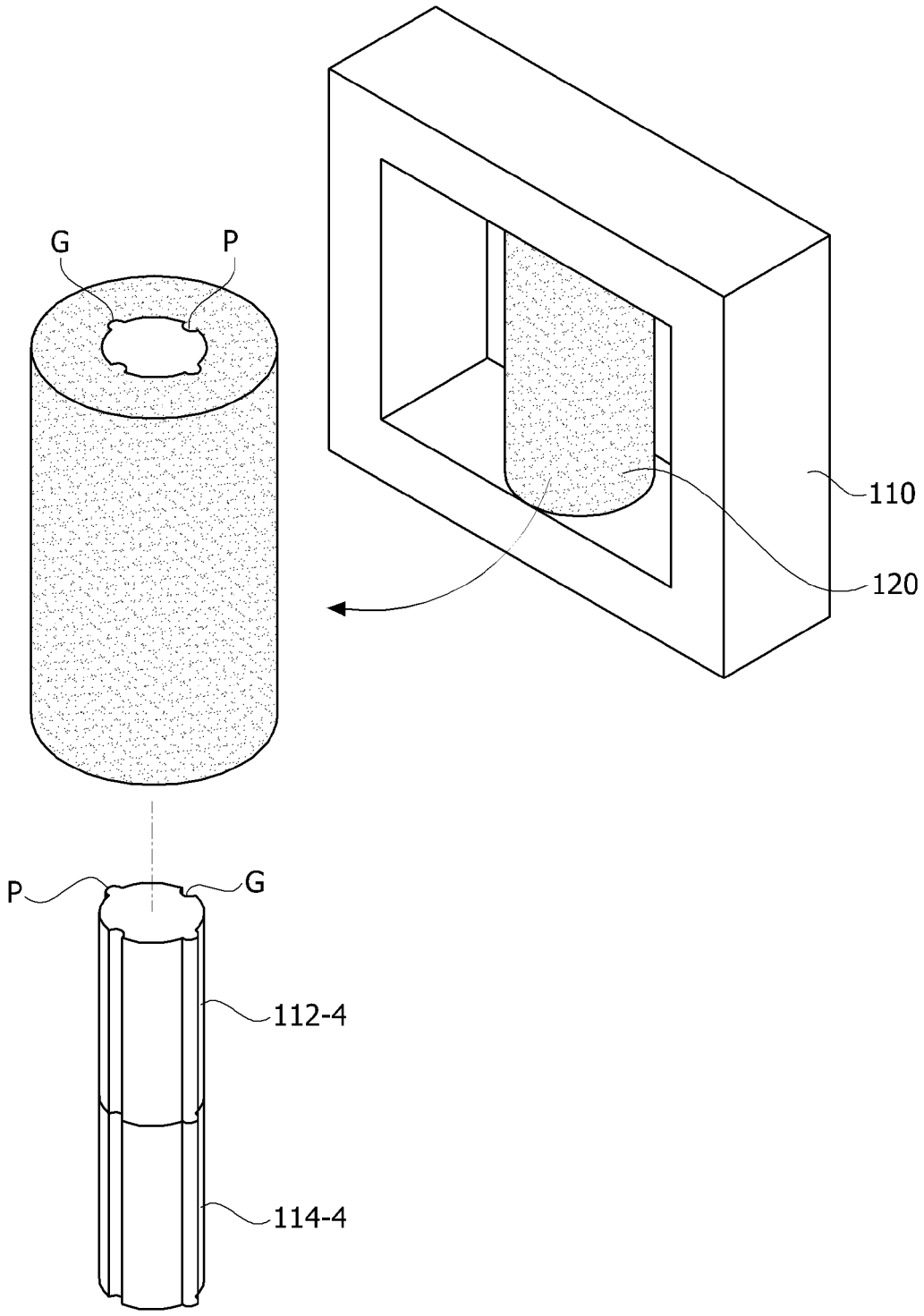

[Fig. 10]
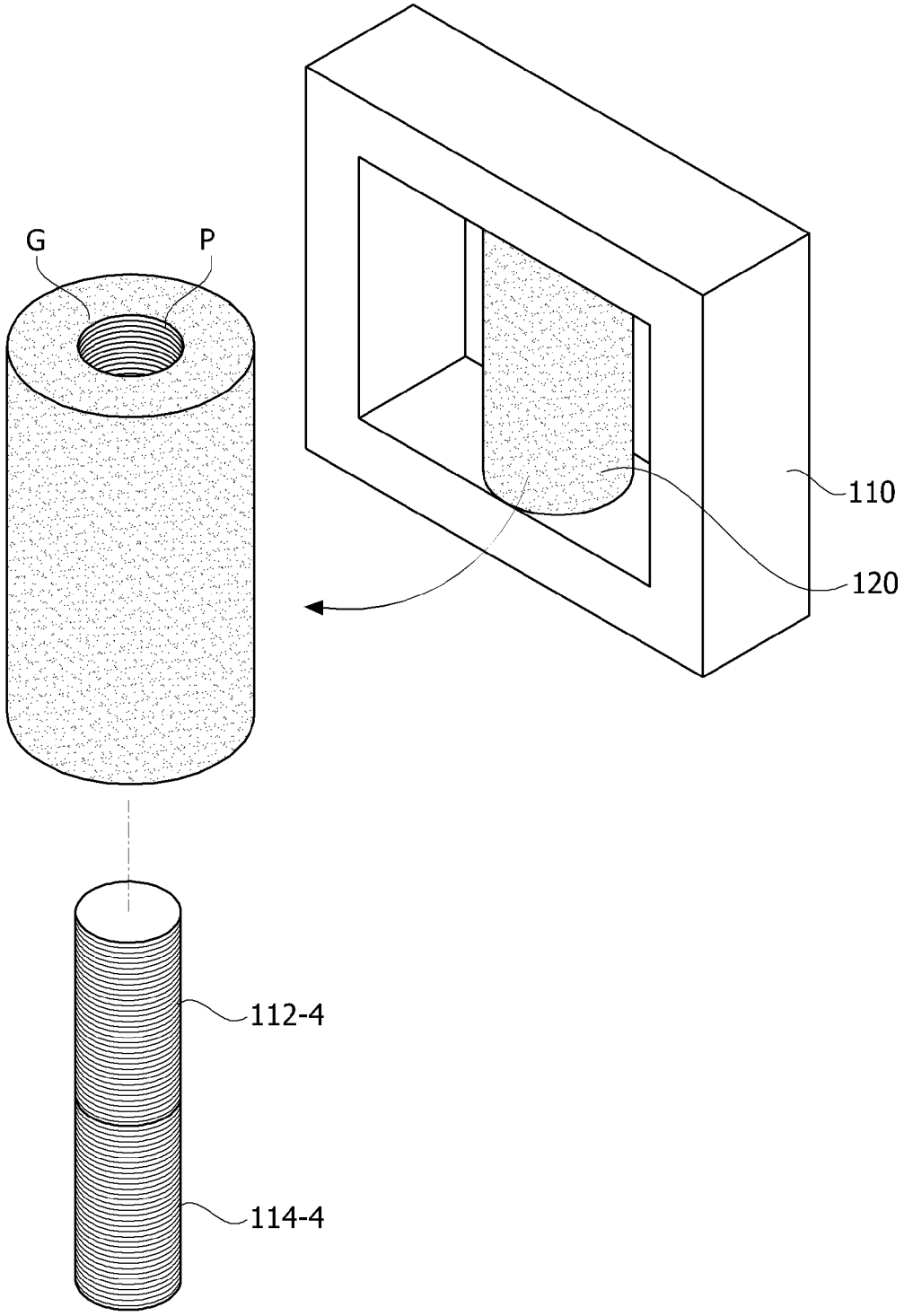

[Fig. 11]
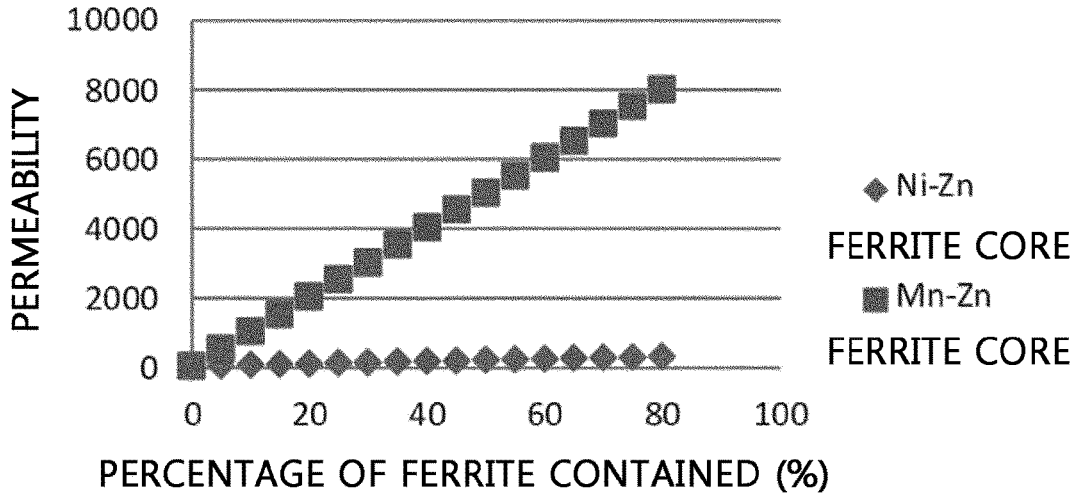
[Fig. 12]
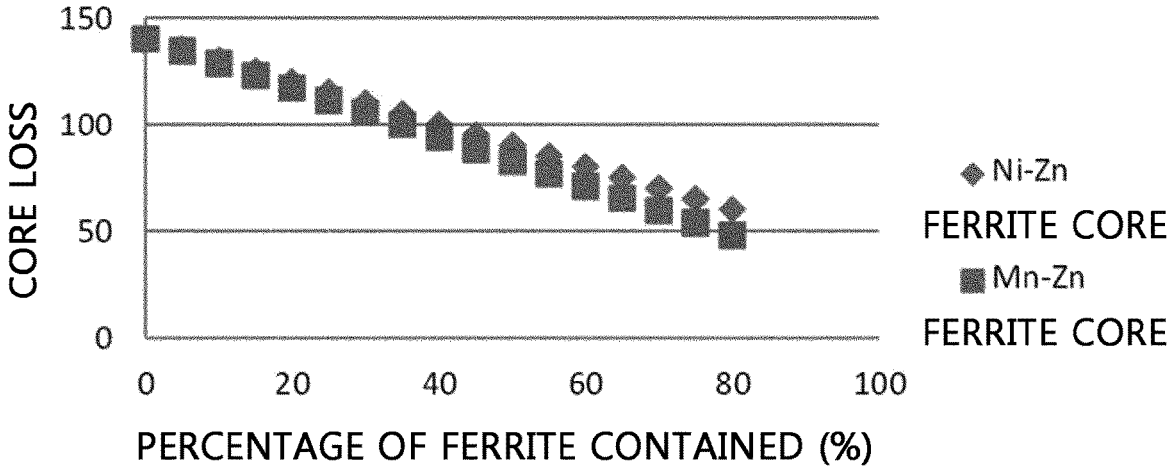
[Fig. 13]
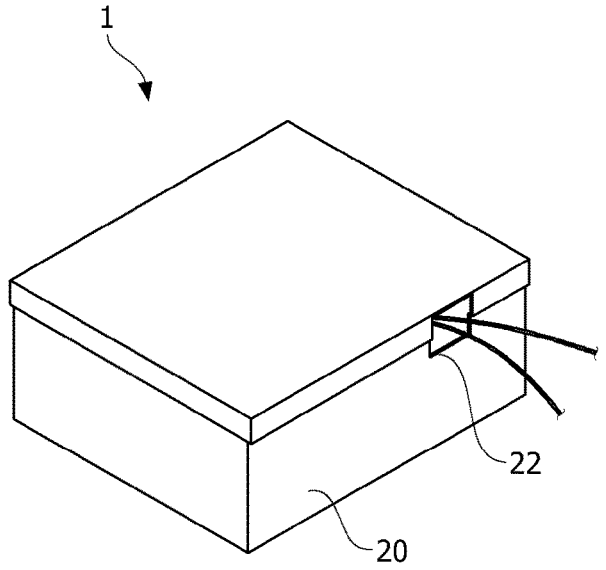

[Fig. 14]
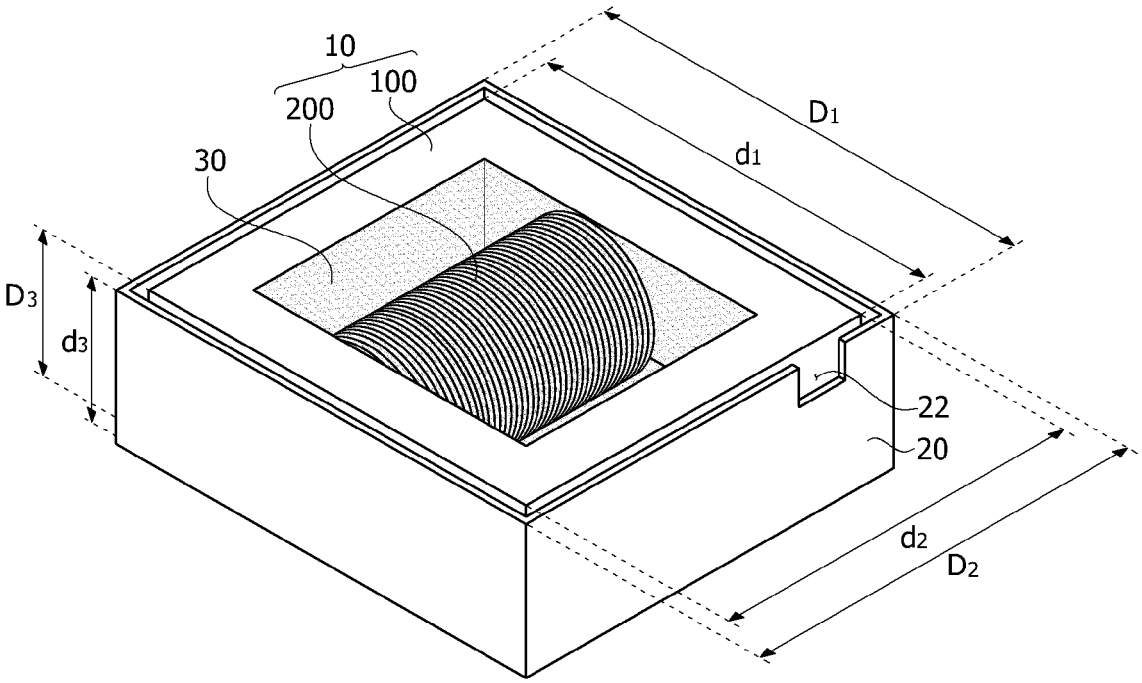
[Fig. 15]
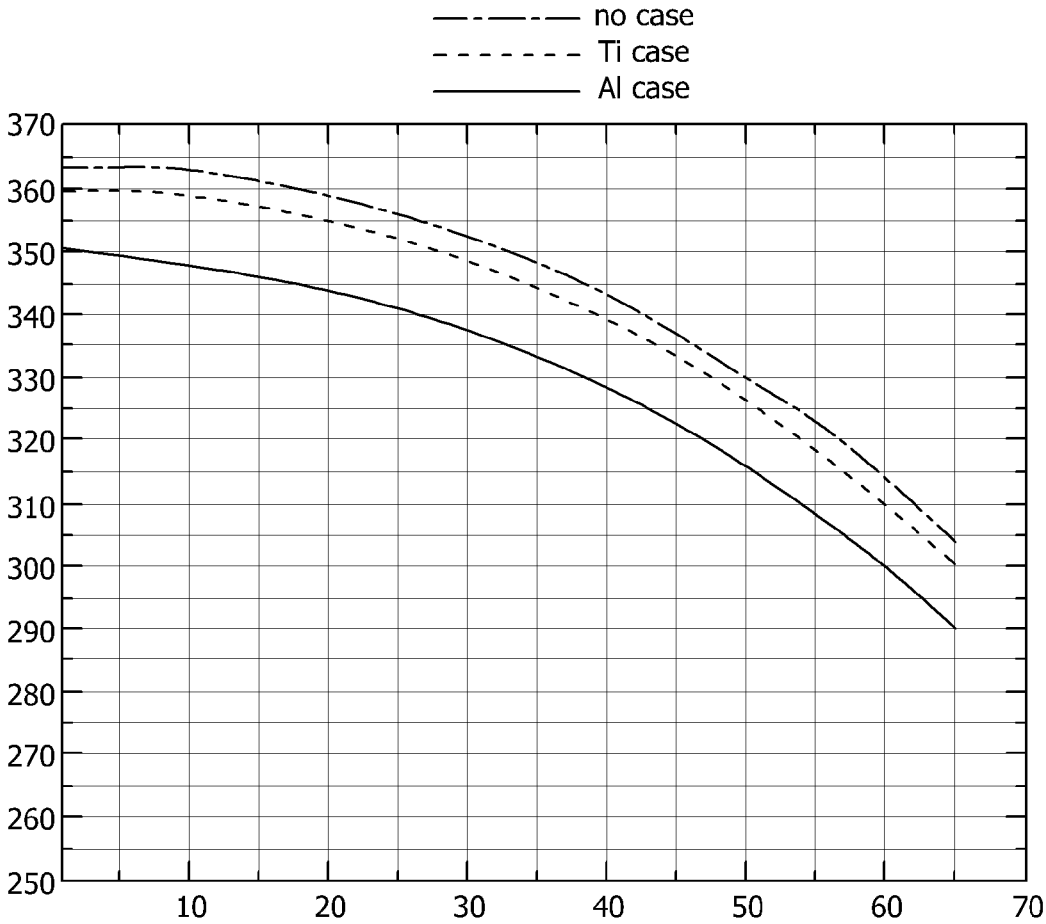

[Fig. 16]
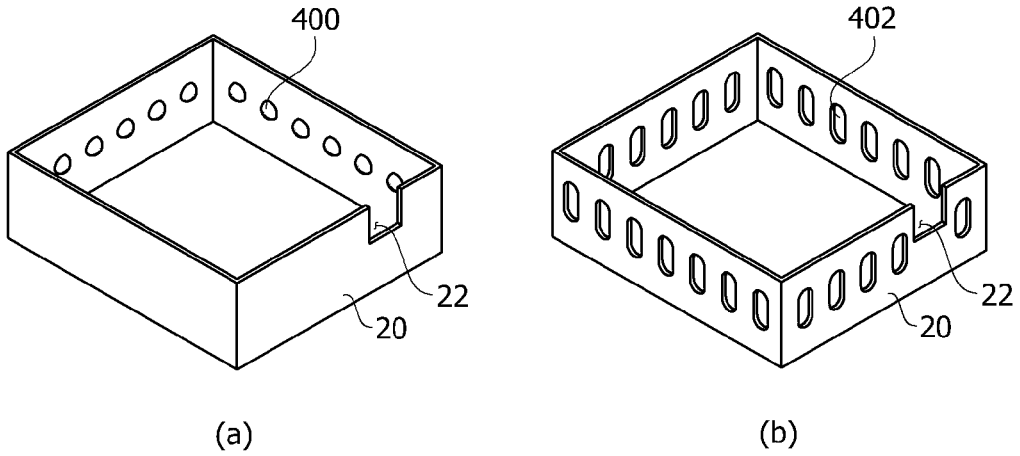

MAGNETIC CORE, COIL COMPONENT, AND ELECTRONIC COMPONENT INCLUDING SAME

CROSS-REFERENCE TO RELATED PATENT APPLICATIONS

This application is a U.S. National Stage Application under 35 U.S.C. § 371 of PCT Application No. PCT/KR2017/015019, filed Dec. 19, 2017, which claims priority to Korean Patent Application No. 10-2016-0174876, and Korean Patent Application No. 10-2016-0174877, both filed Dec. 20, 2016, whose entire disclosures are hereby incorporated by reference.

TECHNICAL FIELD

The present invention relates to a magnetic core, a coil component, and an electronic component including the same.

BACKGROUND ART

High-current step-down inductors, high-current step-up inductors, and three-phase line reactors for power factor correction (PFC) used in photovoltaic systems, wind power generation systems, electric vehicles, and the like include coils wound around magnetic cores. An inductance of a magnetic core included in a high-current inductor or a high-current reactor should be increased to increase a direct current (DC) superposition characteristic at a high-current, reduce a core loss at a high frequency, and obtain stable permeability. The inductance can be determined according to Equation 1.

$$L = A_L N^2 \propto \mu\left(\frac{Ae}{l_e}\right)N^2 \quad \text{[Equation 1]}$$

Here, AL is an inductance of one turn (Ts), N is the number of winding turns, μ is permeability, A is a cross-sectional area of a core, le is a length of a magnetic path, and L is an inductance.

According to Equation 1, an inductance can be adjusted using permeability, the number of winding turns, a cross-sectional area of a core, and the like.

Meanwhile, a metal core formed by molding a pure iron powder or an iron-based alloy powder may be used to improve a high DC superposition characteristic at a high-current, but there is a problem in that permeability and core loss performance are low.

Accordingly, there is an attempt to use a ferrite core, which is formed by molding ferrite, together with a metal core because ferrite is excellent in permeability and core loss performance even though its DC charging characteristic is low. However, in a hybrid core including the metal core and the ferrite core, a gap (G) may be formed at a junction between the metal core and the ferrite core, and thus there are problems in that reliability of the magnetic core is lowered due to the gap and an inductance is lowered over time.

DISCLOSURE OF INVENTION

Technical Problem

The present invention is directed to a magnetic core applicable to a high-current, a coil component including the magnetic core, and an electronic component including the coil component.

Solution to Problem

One aspect of the present invention provides a magnetic core including a first magnetic core including pure iron or an Fe-based alloy, and a second magnetic core configured to surround at least a part of an outer circumferential surface of the first magnetic core and including ferrite.

The first magnetic core may include a pair of partial magnetic cores, each partial magnetic core may include a core, a first leg, a second leg, and a third leg, the first leg, the second leg and the third leg may be integrally formed with the core, the third leg may be interposed between the first leg and the second leg, the pair of partial magnetic cores may be disposed to face each other, and the first leg, the second leg, and the third leg included in a first partial magnetic core, which is one of the pair of partial magnetic cores, may be respectively connected to the first leg, the second leg, and the third leg included in a second partial magnetic core, which is the remaining one of the pair of partial magnetic cores.

The second magnetic core may surround at least one of outer circumferential surfaces of the first legs included in the pair of partial magnetic cores, outer circumferential surfaces of the second legs included in the pair of partial magnetic cores, and outer circumferential surfaces of the third legs included in the pair of partial magnetic cores.

The second magnetic core may integrally surround the at least one of the outer circumferential surface of the two first legs included in the pair of partial magnetic cores, the outer circumferential surfaces of the two second legs included in the pair of partial magnetic cores, and the outer circumferential surfaces of the two third legs included in the pair of partial magnetic cores together.

A hollow configured to surround the outer circumferential surface may be formed in the second magnetic core, and an inner circumferential surface of the hollow may be in contact with the outer circumferential surface.

At least one of a groove and a protrusion may be formed at the inner circumferential surface of the hollow, and at least one of a protrusion and a groove configured to correspond to and be fitted to the at least one of the groove and the protrusion formed in the inner circumferential surface of the hollow may be formed at the outer circumferential surface.

The at least one of the groove and the protrusion formed at the inner circumferential surface of the hollow and the at least one of the protrusion and the groove formed at the outer circumferential surface may extend downward from a top.

The at least one of the groove and the protrusion formed at the inner circumferential surface of the hollow may be screw coupled to the at least one of the protrusion and the groove formed at the outer circumferential surface.

The second magnetic core may include Ni—Zn-based ferrite or Mn—Zn-based ferrite.

Another aspect of the present invention provides a coil part including a magnetic core, and a coil wound around the magnetic core, wherein the magnetic core includes a first magnetic core including pure iron or an Fe-based alloy and a second magnetic core disposed to surround at least a part of an outer circumferential surface of the first magnetic core and including ferrite, and the coil is wound around the second magnetic core.

Still another aspect of the present invention provides an electronic part including a magnetic core, a coil wound around the magnetic core, and a case having the magnetic core and the coil, wherein the case includes titanium (Ti).

The case may include a groove configured to allow both ends of the coil to be withdrawn therefrom.

An inside of the case may be filled with a resin.

Advantageous Effects of Invention

According to an embodiment of the present invention, a magnetic core having a high direct current (DC) superposition characteristic, a high permeability, and a low core loss rate, and a coil part including the same may be formed. In addition, the permeability and the core loss rate can be adjusted according to a user's needs. Accordingly, the magnetic core and the coil part according to the embodiment of the present invention can be applied to a high-current inductor, a high-current reactor, and the like for a vehicle and industrial facility.

According to the embodiment of the present invention, a case for accommodating a coil part having superior heat radiation performance and a low inductance loss rate can be formed. As described above, since inductance loss rates before and after the coil part is assembled in the case are low, characteristic degradation of an electronic part can be prevented, and an excessive size increase can be prevented.

BRIEF DESCRIPTION OF DRAWINGS

FIG. 1 is a perspective view illustrating a magnetic core according to one embodiment of the present invention.

FIG. 2 is a perspective view illustrating a coil part including the magnetic core according to one embodiment of the present invention.

FIG. 3 is a perspective view illustrating various shapes of a first magnetic core included in the magnetic core according to the embodiment of the present invention.

FIG. 4 is a perspective view illustrating various shapes of a second magnetic core included in the magnetic core according to the embodiment of the present invention.

FIG. 5 is a view illustrating one example of an assembly process of the magnetic core according to the embodiment of the present invention.

FIG. 6 is a view illustrating another example of an assembly process of the magnetic core according to the embodiment of the present invention.

FIGS. 7 to 9 are views illustrating examples of contact areas of the first magnetic core and the second magnetic core according to one embodiment of the present invention.

FIG. 10 is a view illustrating another example of the contact areas of the first magnetic core and second magnetic core according to one embodiment of the present invention.

FIG. 11 is a graph showing permeability according to a volume ratio of the first magnetic core and the second magnetic core.

FIG. 12 is a graph showing a core loss rate according to the volume ratio of the first magnetic core and the second magnetic core.

FIG. 13 is a perspective view illustrating an electronic part according to one embodiment of the present invention.

FIG. 14 is a perspective view illustrating an inside of the electronic part according to one embodiment of the present invention.

FIG. 15 is a simulation graph showing inductances of a coil part which is not accommodated in a case, a coil part accommodated in an aluminum case, and a coil part accommodated in a titanium case.

FIG. 16 is a view illustrating various examples of a case configured to accommodate the coil part according to one embodiment of the present invention.

MODE FOR THE INVENTION

While the invention can be modified in various ways and take on various alternative forms, specific embodiments thereof are shown in the drawings and described in detail below as examples. There is no intent to limit the invention to the particular forms disclosed. On the contrary, the invention is to cover all modifications, equivalents, and alternatives falling within the spirit and scope of the appended claims.

It should be understood that, although the terms "first," "second," and the like may be used herein to describe various elements, these elements are not limited by these terms. These terms are only used to distinguish one element from another. For example, a first element could be termed a second element, and, similarly, a second element could be termed a first element without departing from the scope of the present invention. As used herein, the term "and/or" includes any and all combinations of one or more of the associated listed items.

It should be understood that, when an element is referred to as being "connected" or "coupled" to another element, the element can be directly connected or coupled to the other element or intervening elements may be present. Conversely, when an element is referred to as being "directly connected" or "directly coupled" to another element, there are no intervening elements.

While describing embodiments, meanings of layers (films), areas, patterns, or structures being formed above (on) or below (under) other layers (films), areas, patterns, or structures include being the layers (films), areas, patterns, or structures formed directly above (on) or below (under) the other layers (films), areas, patterns, or structures, or yet other layers being interposed therebetween. References of being above/on or below/under layers are the accompanying drawings. In addition, thicknesses or sizes of layers (films), areas, patterns, or structures in the drawings do not fully reflect the actual thicknesses or sizes thereof because the thicknesses or sizes may vary for the sake of clearness and convenience of description. The terms used in the present specification are merely used to describe exemplary embodiments, and are not intended to limit embodiments. An expression used in the singular encompasses the expression of the plural, unless it has a clearly different meaning in the context. In the present specification, it should be understood that the terms such as "including," "having," and "comprising" are intended to indicate the existence of features, numbers, steps, actions, components, parts, or combinations thereof disclosed in the specification, and are not intended to preclude the possibility that one or more other features, numbers, steps, actions, components, parts, or combinations thereof may exist or be added.

Unless otherwise defined, all terms including technical and scientific terms used herein should be interpreted as is customary in the art to which this invention belongs. It should be further understood that terms in common usage should also be interpreted as is customary in the relevant art and not in an idealized or overly formal sense unless expressly so defined herein.

Hereinafter, embodiments will be illustrated in detail with reference to the accompanying drawings, and components that are the same or correspond to each other regardless of reference numerals will be referred to by the same or similar reference numerals, and redundant descriptions thereof will be omitted.

FIG. 1 is a perspective view illustrating a magnetic core according to one embodiment of the present invention, and FIG. 2 is a perspective view illustrating a coil part including the magnetic core according to one embodiment of the present invention.

Referring to FIGS. 1 and 2, a coil part 10 includes a magnetic core 100 and a coil 200 wound around the magnetic core 100. The coil part 10 can refers to a coil component.

The magnetic core 100 includes a first magnetic core 110 and a second magnetic core 120 disposed to surround at least a part of an outer circumferential surface of the first magnetic core 110.

The first magnetic core 110 may include a pure iron or Fe-based magnetic powder. The Fe-based magnetic powder may include, for example, at least one selected from the group consisting of an Fe—Si—B-based magnetic powder, an Fe—Ni-based magnetic powder, an Fe—Si-based magnetic powder, an Fe—Si—Al-based magnetic powder, an Fe—Ni—Mo-based magnetic powder, an Fe—Si—B-based magnetic powder, an Fe—Si—C-based magnetic powder, and an Fe—B—Si—Nb—Cu-based magnetic powder, but is not limited thereto. The first magnetic core 110 may be manufactured through a method in which the pure iron or Fe-based magnetic powder is coated with and insulated by a ceramic or polymer binder, and is molded under a high pressure. Alternatively, the first magnetic core 110 may also be manufactured through a method in which the pure iron or Fe-based magnetic powder is coated with the ceramic or polymer binder, and a plurality of magnetic sheets that are formed by insulating the coated pure iron or Fe-based magnetic powder are stacked.

The second magnetic core 120 may include a ferrite powder. The ferrite powder may be, for example, a Ni—Zn-based ferrite powder or a Mn—Zn-based ferrite powder. The second magnetic core 120 may be manufactured through a method in which the ferrite powder is coated with and insulated by a ceramic or polymer binder, and is molded under a high pressure. Alternatively, the second magnetic core 120 may also be manufactured through a method in which the ferrite powder is coated with the ceramic or polymer binder, and a plurality of magnetic sheets that are formed by insulating the coated ferrite powder are stacked.

Here, the coil 200 may be wound around the second magnetic core 120, and an insulating layer such as a bobbin may be further interposed between the coil 200 and the second magnetic core 110. The coil 200 may be formed of a conducting wire having a surface coated with an insulating material. The conducting wire may be formed of copper, silver, aluminum, gold, nickel, tin, or the like having a surface coated with the insulating material, and a cross section of the conducting wire may have a circular or square shape.

Both ends of the coil 200 may be connected to electrodes (not shown).

According to the embodiment of the present invention, in a case in which the magnetic core 100 includes the first magnetic core 110 having the pure iron or Fe-based alloy and the second magnetic core 120 having the ferrite powder, a direct current (DC) superposition characteristic of the first magnetic core 110 is high, permeability of the second magnetic core 120 is high, and a core loss rate of the second magnetic core 120 is low, and thus an inductor or reactor applicable to a high-current may be formed.

In addition, according to the embodiment of the present invention, a required level of permeability and a core loss rate may be achieved by adjusting a volume ratio of the first magnetic core 110 and the second magnetic core 120.

In addition, according to the embodiment of the present invention, since the second magnetic core 120 is disposed to surround the outer circumferential surface of the first magnetic core 110, the second magnetic core 120 may be easily bonded to the first magnetic core 110, and durability thereof is high because the possibility of the second magnetic core 120 being separated from the first magnetic core 110 is low.

Hereinafter, the magnetic core according to the embodiment of the present invention will be described in more detail with reference the accompanying drawings.

FIG. 3 is a perspective view illustrating various shapes of the first magnetic core included in the magnetic core according to the embodiment of the present invention, FIG. 4 is a perspective view illustrating various shapes of the second magnetic core included in the magnetic core according to the embodiment of the present invention, FIG. 5 is a view illustrating one example of an assembly process of the magnetic core according to the embodiment of the present invention, and FIG. 6 is a view illustrating another example of an assembly process of the magnetic core according to the embodiment of the present invention.

Referring to FIG. 3, the first magnetic core 110 includes a pair of partial magnetic cores 112 and 114. The partial magnetic cores 112 and 114 include magnetic cores 112-1 and 114-1, first legs 112-2 and 114-2, second legs 112-3 and 114-3, and third legs 112-4 and 114-4 having the same materials as the magnetic cores 112-1 and 114-1 and integrally formed with the magnetic cores 112-1 and 114-1. The first legs 112-2 and 114-2, the second legs 112-3 and 114-3, and the third legs 112-4 and 114-4 are parallel, and the third legs 112-4 and 114-4 are interposed between the first legs 112-2 and 114-2 and the second legs 112-3 and 114-3, respectively. In FIGS. 3A and 3B, an EER core and an EE core are illustrated as the first magnetic core 110, but the first magnetic core 110 is not limited there to, and various shapes such as an ER core, an EQ core, and a PQ core may be used as the first magnetic core 110.

In the magnetic core 100 according to one embodiment of the present invention, the pair of partial magnetic cores 112 and 114 may be disposed to face each other, and the first leg 112-2, the second leg 112-3, and the third leg 112-4 included in the first partial magnetic core 112, which is one of the pair of partial magnetic cores, may respectively contact with the first leg 114-2, the second leg 114-3, and the third leg 114-4 included in the second partial magnetic core 114, which is the remaining one of the pair of partial magnetic cores.

Referring to FIG. 4, a hollow h may be formed in the second magnetic core 120 to surround at least one of outer circumferential surfaces of the first legs 112-2 and 114-2, outer circumferential surfaces of the second legs 112-3 and 114-3, and outer circumferential surfaces of the third legs 112-4 and 114-4 included in the first magnetic core 110. The hollow h may have a shape corresponding to a shape of the at least one of the outer circumferential surfaces of the first legs 112-2 and 114-2, the second legs 112-3 and 114-3, and the third legs 112-4 and 114-4.

Referring to FIG. 5, when the first partial magnetic core 112 including the first leg 112-2, the second leg 112-3, and the third leg 112-4, the second partial magnetic core 112 including the first leg 114-2, the second leg 114-3, and the third leg 114-4, and the second magnetic core 120 in which the hollow h is formed are prepared (see FIG. 5A), the third leg 112-4 of the first partial magnetic core 112 is coupled to one end of the second magnetic core 120 (See FIG. 5B). Accordingly, the one end of the second magnetic core 120 is disposed to surround the outer circumferential surface of the third leg 112-4 of the first partial magnetic core 112, and an inner circumferential surface of the one end of the surface second magnetic core 120 is in contact with the outer circumferential surface of the third leg 112-4. Next, the other end of the second magnetic core 120 is coupled to the third leg 114-4 of the second partial magnetic core 114 (see FIG. 5C). Accordingly, the other end of the second magnetic core 120 may be disposed to surround the outer circumferential surface of the third leg 114-4 of the second partial magnetic core 114, and an inner circumferential surface of the other end of the second magnetic core 120 may be in contact with the outer circumferential surface of the third leg 114-4.

As described above, the second magnetic core 120 may integrally surround the circumferential surfaces of the two third legs included in the pair of partial magnetic cores 112 and 114.

In another embodiment, referring to FIG. 6, when a first partial magnetic core 112 including a first leg 112-2, a second leg 112-3, and a third leg 112-4, a second partial magnetic core 112 including a first leg 114-2, a second leg 114-3, and a third leg 114-4, and two second magnetic cores 120-1 and 120-2 in which hollows h are formed are provided (see FIG. 6A), the third leg 112-4 of the first partial magnetic core 112 is coupled to one second magnetic core 120-1 (see FIG. 6B). Accordingly, the second magnetic core 120-1 may be disposed to surround an outer circumferential surface of the third leg 112-4 of the first partial magnetic core 112, and an inner circumferential surface of the second magnetic core 120-1 may be in contact with the outer circumferential surface of the third leg 112-4. Next, the remaining one second magnetic core 120-2 is coupled to the third leg 114-4 of the second partial magnetic core 114 (see FIG. 6C). Accordingly, the second magnetic core 120-2 may be disposed to surround an outer circumferential surface of the third leg 114-4 of the second partial magnetic core 114, and an inner circumferential surface of the second magnetic core 120-2 may be in contact with the outer circumferential surface of the third leg 114-4.

In FIGS. 5 and 6, the second magnetic core 120 is shown to surround the third legs 112-4 and 114-4 respectively included in the pair of partial magnetic cores 112 and 114 for the sake of convenience in the description, but is not limited thereto. The second magnetic core 120 may surround the first legs 112-2 and 114-2 respectively included in the pair of partial magnetic cores 112 and 114, or may also surround the second legs 112-3 and 114-3 respectively included in the pair of partial magnetic cores 112 and 114. Alternatively, two second magnetic cores 120 may also surround the first legs 112-2 and 114-2 and the second legs 112-3 and 114-3 respectively included in the pair of partial magnetic cores 112 and 114.

Meanwhile, according to the embodiment of the present invention, at least one of a groove and a protrusion may be formed at an inner circumferential surface of the hollow of the second magnetic core 120, and at least one of a protrusion and a groove corresponding to the groove and the protrusion formed at the inner circumferential surface of the hollow may be formed at the outer circumferential surfaces of the third legs 112-4 and 114-4.

FIGS. 7 to 9 are views illustrating examples of contact areas of the first magnetic core and the second magnetic core according to one embodiment of the present invention, and FIG. 10 is a view illustrating another example of the contact areas of the invention first magnetic core and second magnetic core according to one embodiment of the present.

Referring to FIG. 7, at least one protrusion P may be formed at the inner circumferential surface of the second magnetic core 120 to extend downward from a top thereof, at least one groove G may be formed in each of the outer circumferential surfaces of the third legs 112-4 and 114-4 of the first magnetic core 110 to extend downward from a top thereof, and the protrusion P of the second magnetic core 120 may be inserted into the grooves G of the third legs 112-4 and 114-4.

Alternatively, referring to FIG. 8, at least one groove G may be formed in the inner circumferential surface of the second magnetic core 120 to extend downward from the top, at least one protrusion P may be formed at each of the outer circumferential surfaces of the third legs 112-4 and 114-4 of the first magnetic core 110 to extend downward from the top, and the protrusions P of the third legs 112-4 and 114-4 may be inserted into the groove G of the second magnetic core 120.

Alternatively, referring to FIG. 9, grooves G and protrusions P may be alternately formed at the inner circumferential surface of the second magnetic core 120 to extend downward from the top, protrusions P and grooves G may be alternately formed at the outer circumferential surfaces of the third legs 112-4 and 114-4 of the first magnetic core 110 to extend downward from the top, and the protrusions P may be inserted into the grooves G.

Referring to FIG. 10, at least one of a groove G and a protrusion P formed at the inner circumferential surface of the hollow of the second magnetic core 120 may be formed in a shape which may be screw coupled to at least one of a protrusion P and a groove G formed at the outer circumferential surfaces of the third legs 112-4 and 114-4 of the first magnetic core 110.

Then, as a coupling force between the first magnetic core 110 and the second magnetic core 120 increases, the possibility of twisting between the first magnetic core 110 and the second magnetic core 120 occurring or the possibility of the first magnetic core 110 being separated from the second magnetic core 120 may be low even after the magnetic cores are used for a long period of time.

According to the embodiment of the present invention, permeability and a core loss rate may be adjusted by adjusting the volume ratio of the first magnetic core 110 including the pure iron or Fe-based magnetic powder and the second magnetic core 120 including the ferrite powder.

Tables 1 and 2 show permeability and a core loss rate according to the volume ratio of the first magnetic core 110 and the second magnetic core 120, FIG. 11 is a graph showing permeability according to the volume ratio of the first magnetic core 110 and the second magnetic core 120, and FIG. 12 is a graph showing a core loss rate according to the volume ratio of the first magnetic core 110 and the second magnetic core 120.

TABLE 1

| SECOND MAGNETIC CORE (Ni—Zn, vol %) | FIRST MAGNETIC CORE (vol %) | PERMEABILITY (μ) | CORE LOSS RATE (Pcv) |
|---|---|---|---|
| 0 | 100 | 60 | 140 |
| 5 | 95 | 77 | 135 |

TABLE 1-continued

| SECOND MAGNETIC CORE (Ni—Zn, vol %) | FIRST MAGNETIC CORE (vol %) | PERMEABILITY (μ) | CORE LOSS RATE (Pcv) |
|---|---|---|---|
| 10 | 90 | 94 | 130 |
| 15 | 85 | 111 | 125 |
| 20 | 80 | 128 | 120 |
| 25 | 75 | 145 | 115 |
| 30 | 70 | 162 | 110 |
| 35 | 65 | 179 | 105 |
| 40 | 60 | 196 | 100 |
| 45 | 55 | 213 | 95 |
| 50 | 50 | 230 | 90 |
| 55 | 45 | 247 | 85 |
| 60 | 40 | 264 | 80 |
| 65 | 35 | 281 | 75 |
| 70 | 30 | 298 | 70 |
| 75 | 25 | 315 | 65 |
| 80 | 20 | 332 | 60 |

TABLE 2

| SECOND MAGNETIC CORE (Mn—Zn, vol %) | FIRST MAGNETIC CORE (vol %) | PERMEABILITY (μ) | CORE LOSS RATE (Pcv) |
|---|---|---|---|
| 0 | 100 | 60 | 140 |
| 5 | 95 | 557 | 134 |
| 10 | 90 | 1,054 | 129 |
| 15 | 85 | 1,551 | 123 |
| 20 | 80 | 2,048 | 117 |
| 25 | 75 | 2,545 | 111 |
| 30 | 70 | 3,042 | 106 |
| 35 | 65 | 3,539 | 100 |
| 40 | 60 | 4,036 | 94 |
| 45 | 55 | 4,533 | 88 |
| 50 | 50 | 5,030 | 83 |
| 55 | 45 | 5,527 | 77 |
| 60 | 40 | 6,024 | 71 |
| 65 | 35 | 6,521 | 65 |
| 70 | 30 | 7,018 | 60 |
| 75 | 25 | 7,515 | 54 |
| 80 | 20 | 8,012 | 48 |

Referring to tables 1 to 2 and FIGS. 11 to 12, it can be seen that various permeabilities and core loss rates can be obtained according various volume ratios of the first magnetic core and the second magnetic core and kinds of materials included in the second magnetic cores.

Meanwhile, an inductor or reactor is accommodated in a case, and the case is filled with a resin. Here, a case formed of an aluminum material is used to effectively radiate heat generated by the inductor or reactor.

However, there are problems in that aluminum decreases inductance by interrupting a magnetic flux, and thus a bigger case is formed to compensate for the decreased inductance.

Hereinafter, a case for accommodating an inductor or reactor according to the embodiment of the present invention will be described.

FIG. 13 is a perspective view illustrating an electronic part according to one embodiment of the present invention, and FIG. 14 is a perspective view illustrating an inside of the electronic part according to one embodiment of the present invention.

Referring to FIGS. 13 and 14, an electronic part 1 includes the coil part 10 and a case 20 configured to accommodate the coil part 10. Here, the coil part 10 may include the magnetic core 100 and the coil 200 wound around the magnetic core 100.

According to the embodiment of the present invention, the case 20 may include titanium (Ti). Titanium has a higher specific resistance (mΩ·cm) and a lower conductivity (G) than aluminum (Al). Accordingly, in a case in which the coil part 10 is accommodated in the case formed of titanium, an inductance loss rate is lower than that of a case in which the coil part 10 is accommodated in a case formed of aluminum. Here, the inductance loss rate is a percentage by which the inductance is reduced from before the coil part 10 is accommodated in the case 20 to after the coil part 10 is accommodated in the case 20. The fact that an inductance loss rate of a case formed of titanium is lower than that of a case formed of aluminum will be described in more detail using the following Equation.

$$S_E = \text{Reflection}(R_E + R_H + R_P) + \text{Absorption}(A_E + A_M) \quad \text{[Equation 2]}$$

Here, $S_E$ is a shield effect, $R_E$ is an electric field reflection, $R_H$ is a magnetic field reflection, $R_P$ is a plane wave reflection, $A_E$ is an eddy current loss, and $A_M$ is a parameter regarding a magnetic loss and a dielectric loss.

Since all of $R_E$, $R_H$, $R_P$, $A_E$, and $A_M$ are proportional to conductivity (G), the shield effect ($S_E$) is also proportional to the conductivity. Since conductivity of aluminum is greater than that of titanium, a shield effect of aluminum is greater than that of titanium. Since a shield effect of an inductor interferes in a formation of a magnetic flux, reduction of a magnetic characteristic such as an inductance occurs. That is, in a case in which the coil part 10 is accommodated in a case formed of titanium having a lower shield effect than aluminum, an inductance loss rate of the coil part 10 before and after the coil part 10 is accommodated in the case 20 is low.

FIG. 15 is a simulation graph showing inductances of a coil part which is not accommodated in a case, a coil part accommodated in an aluminum case, and a coil part accommodated in a titanium case.

Referring to FIG. 15, it can be seen that a difference in inductance of the coil part before and after the coil is accommodated in the case formed of titanium is less than a difference in inductance of the coil part before and after the coil is accommodated in the case formed of aluminum. Accordingly, it can be seen that since the inductance loss rate of about −1.5% of the titanium case is lower than the inductance loss rate of about −4.5% of the aluminum case, performance of the coil part accommodated in the titanium case is superior to that of the coil part accommodated in the aluminum case.

As described above, when the inductance loss rate is low, it is not necessary to increase a size of the case 20 to compensate for the reduced inductance.

Accordingly, referring back to FIG. 14, a tolerance between the case 20 and the coil part 10 accommodated in the case 20 may be within 0.1 times, preferably within 0.05 times, and more preferably within 0.01 times of the size of the case 20. For example, a transverse length d1, a longitudinal length d2, and a height d3 of the coil part 10 may be within 0.8 times, preferably within 0.9 times, and more preferably within 0.98 times of a transverse length D1, a case length D2, and a height D3 of the case 20, respectively. As described above, in the case in which the case formed of titanium is used, since it is not necessary to form the case 20 to be big, the electronic part 10 which is small can be manufactured.

Here, a groove 22 for withdrawing both ends of the coil 200 of the coil part 10 accommodated in the case 20 may be formed in the case 20 according to the embodiment of the present invention. The groove 22 may be formed in a side surface of the case 20, and both ends of the coil 200 may be withdrawn via one groove 22, but the groove 22 is not limited thereto, and the groove 22 may also be formed in a bottom or top surface of the case 20, and a plurality of grooves 22 may also be formed.

Meanwhile, the case 20 may be filled with a resin 30. The resin 30 may include a thermally conductive resin, for example, a silicone-based resin. Accordingly, heat generated by the coil part 10 may be radiated to the outside of the case 20 via the resin 30.

FIG. 16 is a view illustrating various examples of a case configured to accommodate the coil part according to one embodiment of the present invention. A lower case for accommodating the coil part is illustrated for the sake of convenience in the description, and an upper case may be assembled to the lower case through various methods, and the upper case may have the same shape as the lower case.

Referring to FIG. 16, protrusions 400 (see FIG. 16A), holes 402 (see FIG. 16B), or both the protrusions 400 and the holes 402 may be formed at inner surfaces of the case 20 formed of titanium. Accordingly, it may be easy for heat generated by the coil part 10 to be radiated to the outside of the case 20.

While the example embodiments of the present invention and their advantages have been described above in detail, it should be understood that various changes, substitutions and alterations may be made thereto without departing from the scope of the invention as defined by the following claims.

REFERENCE NUMERALS

110: FIRST MAGNETIC CORE
112, 114: PARTIAL MAGNETIC CORE
112-1, 114-1: MAGNETIC CORE
112-2, 114-2: FIRST LEG
112-3, 114-3: SECOND LEG
112-4, 114-4: THIRD LEG
120: SECOND MAGNETIC CORE

The invention claimed is:

1. A coil component comprising:
a magnetic core; and
a coil wound around the magnetic core,
wherein:
the magnetic core includes a first magnetic core including pure iron or an Fe-based alloy and a second magnetic core disposed to surround and contact at least a part of an outer circumferential surface of the first magnetic core and including ferrite; and
the coil is wound around the second magnetic core, wherein:
the first magnetic core includes a pair of partial magnetic cores,
each partial magnetic core includes a core, a first leg, a second leg, and a third leg,
the first leg, the second leg and the third leg are integrally formed with the core;
the third leg is interposed between the first leg and the second leg,
the pair of partial magnetic cores are disposed to face each other; and
the first leg, the second leg, and the third leg included in a first partial magnetic core, which is one of the pair of partial magnetic cores, are respectively connected to the first leg, the second leg, and the third leg included in a second partial magnetic core, which is the remaining one of the pair of partial magnetic cores,
wherein the second magnetic core is to surround and contact at least one of an outer circumferential surface of the first leg included in the first partial magnetic core, an outer circumferential surface of the second leg included in the first partial magnetic core, and an outer circumferential surface of the third leg included in the first partial magnetic core.

2. The coil component of claim 1, wherein the second magnetic core is to integrally surround and contact the at least one of the outer circumferential surface of the first leg included in the first partial magnetic core, the outer circumferential surface of the second leg included in the first partial magnetic core, and the outer circumferential surface of the third leg included in the first partial magnetic core.

3. The coil component of claim 1, wherein the second magnetic core is to surround and contact the outer circumferential surface of the third leg included in the first partial magnetic core.

4. An electronic part comprising:
a coil component comprising a magnetic core and a coil wound around the magnetic core; and
a case having the coil component,
wherein:
the magnetic core includes a first magnetic core including pure iron or an Fe-based alloy and a second magnetic core disposed to surround and contact at least a part of an outer circumferential surface of the first magnetic core and including ferrite; and
the coil is wound around the second magnetic core, wherein:
the first magnetic core includes a pair of partial magnetic cores,
each partial magnetic core includes a core, a first leg, a second leg, and a third leg,
the first leg, the second leg and the third leg are integrally formed with the core;
the third leg is interposed between the first leg and the second leg,
the pair of partial magnetic cores are disposed to face each other; and
the first leg, the second leg, and the third leg included in a first partial magnetic core, which is one of the pair of partial magnetic cores, are respectively connected to the first leg, the second leg, and the third leg included in a second partial magnetic core, which is the remaining one of the pair of partial magnetic cores,
wherein the second magnetic core is to surround and contact at least one of an outer circumferential surface of the first leg included in the first partial magnetic core, an outer circumferential surface of the second leg included in the first partial magnetic core, and an outer circumferential surface of the third leg included in the first partial magnetic core.

5. The electronic part of claim 4, wherein the case comprises titanium (Ti).

6. The electronic part of claim 5, wherein the case comprises a groove configured to allow both ends of the coil to be withdrawn therefrom.

7. The electronic part of claim 5, wherein an inside of the case is filled with a resin.

8. The electronic part of claim 5, wherein at least one of a protrusion and a hole is formed at an inner surface of the case.

9. The electronic part of claim 5, wherein a tolerance between the case and the coil component is within 0.1 times.

10. An electronic part comprising:

the coil component of claim 1; and a case having the coil component.

11. A coil component comprising:

a magnetic core; and a coil wound around the magnetic core, wherein:

the magnetic core includes a first magnetic core including pure iron or an Fe-based alloy and a second magnetic core disposed to surround and contact at least a part of an outer circumferential surface of the first magnetic core and including ferrite; and the coil is wound around the second magnetic core, wherein:

the first magnetic core includes a pair of partial magnetic cores, each partial magnetic core includes a core, a first leg, a second leg, and a third leg, the first leg, the second leg and the third leg are integrally formed with the core;

the third leg is interposed between the first leg and the second leg, the pair of partial magnetic cores are disposed to face each other; and the first leg, the second leg, and the third leg included in a first partial magnetic core, which is one of the pair of partial magnetic cores, are respectively connected to the first leg, the second leg, and the third leg included in a second partial magnetic core, which is the remaining one of the pair of partial magnetic cores, wherein an inner surface of the second magnetic core is to surround and contact an outer circumferential surface of the third leg included in the first partial magnetic core.

12. The coil component of claim 11, wherein the inner surface of the second magnetic core is to surround and contact an outer circumferential surface of the third leg included in the second partial magnetic core.

13. The coil component of claim 11, wherein:

at least one of a groove and a protrusion is formed at the inner surface of the second magnetic core; and at least one of a protrusion and a groove configured to correspond to and be fitted to the at least one of the groove and the protrusion formed in the inner surface of the second magnetic core is formed at the outer circumferential surface.

14. The coil component of claim 13, wherein the at least one of the groove and the protrusion formed at the inner surface of the second magnetic core and the at least one of the protrusion and the groove formed at the outer circumferential surface extend downward from a top.

15. The coil component of claim 13, wherein the at least one of the groove and the protrusion formed at the inner surface of the second magnetic core is screw coupled to the at least one of the protrusion and the groove formed at the outer circumferential surface.

* * * * *